US010577062B2

(12) United States Patent
Luzader et al.

(10) Patent No.: US 10,577,062 B2
(45) Date of Patent: Mar. 3, 2020

(54) SELF-ORIENTING RAFT

(71) Applicant: GOODRICH CORPORATION, Charlotte, NC (US)

(72) Inventors: Michael A. Luzader, Laveen, AZ (US); Timothy C. Haynes, Prescott Valley, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/948,467

(22) Filed: Apr. 9, 2018

(65) Prior Publication Data

US 2019/0308699 A1 Oct. 10, 2019

(51) Int. Cl.
*B63C 9/04* (2006.01)
*B63C 9/02* (2006.01)

(52) U.S. Cl.
CPC ..... *B63C 9/04* (2013.01); *B63C 2009/023* (2013.01); *B63C 2009/042* (2013.01); *B63C 2009/044* (2013.01)

(58) Field of Classification Search
CPC ..... B63C 9/04; B63C 2009/023; B63C 2009/042; B63C 2009/044
See application file for complete search history.

(56) References Cited

U.S. PATENT DOCUMENTS 4,280,239 A * 7/1981 Brown ..... B63C 9/04 441/42
4,573,933 A * 3/1986 Cameron ..... B63C 9/04 441/16
4,579,536 A * 4/1986 Cameron ..... B63C 9/04 114/121
4,998,900 A * 3/1991 Wright ..... B63C 9/04 114/349
5,967,869 A * 10/1999 Wiggins ..... B63C 9/04 441/38
6,685,520 B1 * 2/2004 Wiggins ..... B63B 43/12 441/40
8,382,541 B1 * 2/2013 Campbell ..... B63C 9/04 114/349
9,364,699 B2 * 6/2016 Gordon ..... A63B 5/11
9,701,374 B2 * 7/2017 Udupi ..... B63B 43/06

* cited by examiner

*Primary Examiner* — S. Joseph Morano
*Assistant Examiner* — Jovon E Hayes
(74) *Attorney, Agent, or Firm* — Snell & Wilmer, L.L.P.

(57) ABSTRACT

The present disclosure provides a self-orienting raft system. The self-orienting raft system may comprise a base comprising a first side and a second side opposite the first side, a first tube wall coupled to the first side of the base, a charged cylinder coupled to a second side of the base, and an anchor coupled to a second side of the base. The charged cylinder and the anchor may be coupled to the second side of the base proximate to a geometric center of the base when the self-orienting raft system is in an inflated configuration.

18 Claims, 5 Drawing Sheets

SELF-ORIENTING RAFT

FIELD OF THE DISCLOSURE

The present disclosure relates to life raft systems and methods, and more particularly, to self-orienting life raft systems and methods.

BACKGROUND OF THE DISCLOSURE

Life rafts may be difficult to orient in the proper configuration during inflation for various reasons, such as adverse weather conditions or incorrect pre-positioning of the life raft in the water. Conventional life raft designs that attempt to remedy this problem tend to be heavy, bulky, and expensive.

SUMMARY OF THE DISCLOSURE

A self-orienting raft system may comprise a base comprising a first side and a second side opposite the first side, a first tube wall coupled to the first side of the base, a charged cylinder coupled to a second side of the base, and an anchor coupled to a second side of the base wherein the charged cylinder and the anchor are coupled to the second side of the base proximate to a geometric center of the base when the self-orienting raft system is in an inflated configuration.

In various embodiments, the self-orienting raft system may further comprise a plurality of inflation tubes coupled to a central chamber and the first tube wall. The central chamber, the plurality of inflation tubes, the first tube wall, and a second tube coupled to the first tube wall may be in fluid communication. The charged cylinder and the anchor may be coupled to the self-orienting raft system proximate to a first end when the self-orienting raft system is in a folded configuration. The second side may be configured to interface with a water surface in an inflated configuration. The anchor may be a sea anchor configured to sink prior to inflation of the self-orienting raft system. The self-orienting raft system may further comprise a canopy comprising at least one canopy arm coupled to and in fluid communication with a top surface of the second tube wall. The first tube wall may comprise a bottom surface and a top surface and the second tube wall comprises a bottom surface and a top surface, the top surface of the first tube wall being coupled to and in fluid communication with the bottom surface of the second tube wall. The first tube wall and the second tube wall may define a perimeter of the first side of the base. The first tube wall, the second tube wall, and the first side of the base may form a passenger compartment. The anchor may be coupled to the self-orienting raft system using anchor cord. A length of the anchor cord may be less than half a diameter of the base of the self-orienting raft system in the inflated configuration.

A raft pack may comprise a raft body, a charged cylinder coupled to the raft body, and an anchor coupled to the raft body, wherein the anchor is coupled proximate to a geometric center of the raft body when the raft body is in an inflated configuration.

In various embodiments, the anchor may be coupled proximate to a first end of the raft body when the raft body is in a folded configuration. The raft body may comprise a base comprising a first side and a second side opposite the first side, a first tube wall comprising a bottom surface and a top surface, a second tube wall comprising a bottom surface and a top surface, and a plurality of inflation tubes coupled to the base and the first tube wall. The first tube wall, the second tube wall, and the plurality of inflation tubes may be in fluid communication. The anchor may be configured to sink prior to inflation of the raft body. The raft body may further comprise a canopy comprising at least one canopy arm coupled to and in fluid communication with the top surface of the second tube wall.

A method for deploying a raft may comprise releasing, by pulling an activation cord, an anchor, sinking, by filing with water, the anchor coupled proximate to a first end of the raft, stabilizing, by the anchor and by a charged cylinder coupled proximate to the first end, the raft in a folded configuration, and inflating, by the charged cylinder, the raft into an inflated configuration from the folded configuration.

In various embodiments, the anchor may be coupled proximate to a geometric center of the raft in the inflated configuration.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, electrical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, methods, systems, and articles may find particular use in connection with life raft systems. However, various aspects of the disclosed embodiments may be adapted for performance in a variety of other systems. As such, numerous applications of the present disclosure may be realized.

Various embodiments of the present disclosure may result in a life raft capable of self-righting into a desired position, without regard to the manner in which it is deployed.

Figure 1A:
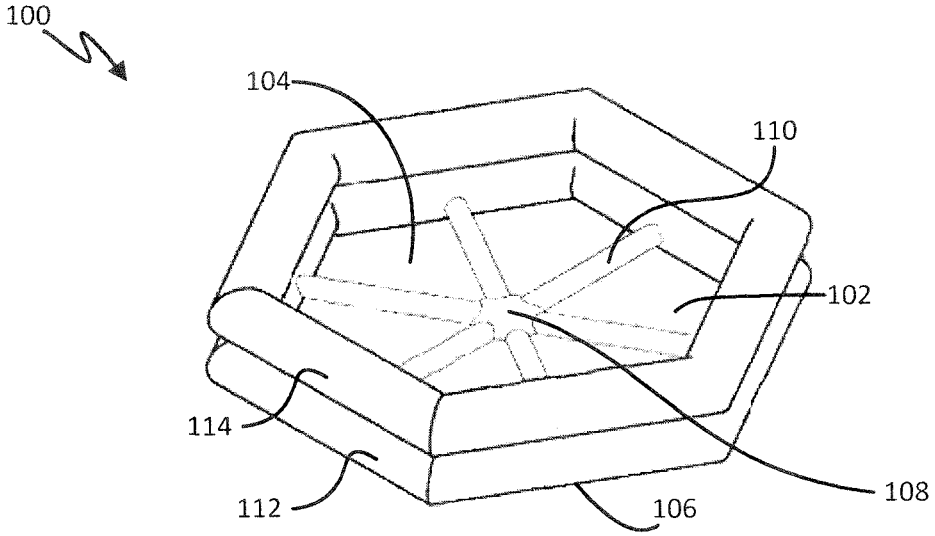
FIG. 1A illustrates a top perspective view of a self-orienting life raft, in accordance with various embodiments.

Referring now to FIG. 1A, self-orienting raft 100 is illustrated in a top perspective view in accordance with various embodiments. Self-orienting raft 100 may comprise a flexible, waterproof material such as a polyurethane polymer, polyvinylchloride polymer or other suitable polymer. Self-orienting raft 100 may comprise a base 102 configured to support passengers and separate passengers from a body of water while self-orienting raft 100 is in operation. Base 102 may comprise a first side 104 and a second side 106 opposite the first side 104 (with momentary reference to FIG. 2). First side 104 may be configured to hold passengers, while second side 106 may be configured to interface with a water surface. A central chamber 108 may be positioned proximate to a geometric center of base 102 (in the y-z plane with momentary reference to FIG. 1B) and be integral with base 102. Central chamber 108 may be configured to receive gases (for example ambient air, $CO_2$ or $N_2$) from a gas source and inflate self-orienting raft 100. For example, in various embodiments, central chamber 108 may receive pressurized gases from a gas source, such as a charged cylinder, and transfer the gases through at least one inflation tube 110 coupled to and in fluid communication with central chamber 108. While in various embodiments, self-orienting raft 100 is illustrated comprising six inflation tubes 110 extending from central chamber 108, self-orienting raft 100 is not limited in this regard and may comprise any suitable number of inflation tubes.

Still referring to FIG. 1A, inflation tubes 110 may extend radially outward from central chamber 108 and be coupled to and in fluid communication with a first tube wall 112. Inflation tubes 110 may be configured to transfer gases from central chamber 108 to a first tube wall 112 of self-orienting raft 100. Inflation tubes 110 may comprise tubes of various shapes. For example, in various embodiments, inflation tubes 110 may comprise a cylindrical shape having a circular cross-sectional shape. However, the shape of inflation tubes 110 are not limited in this regard and may comprise any other suitable shape capable of transferring gases from central chamber 108 to first tube wall 112, including a square, rectangular, oval, triangular, and/or other cross-sectional shape. First tube wall 112 may be coupled to and in fluid communication with a second tube wall 114. Similar to inflation tubes 110, first tube wall 112 and second tube wall 114 may comprise "tubes" of various cross-sectional shapes. First tube wall 112 and second tube wall 114 may form an outer perimeter of base 102 and may be configured to prevent passengers from falling out of self-orienting raft 100 during operation. While in various embodiments, first tube wall 112 and second tube wall 114 comprise a hexagonal shape, first tube wall 112 and second tube wall 114 may comprise any other suitable shape. Base 102, first tube wall 112, and second tube wall 114 may form a compartment configured to seat one or more passengers. Together, central chamber 108, inflation tubes 110, first tube wall 112, second tube wall 114, and canopy 116 (with momentary reference to FIG. 1B) may form the inflated portions of self-orienting raft 100, which may provide buoyant forces sufficient to maintain flotation of self-orienting raft 100 in water.

Figure 1B:
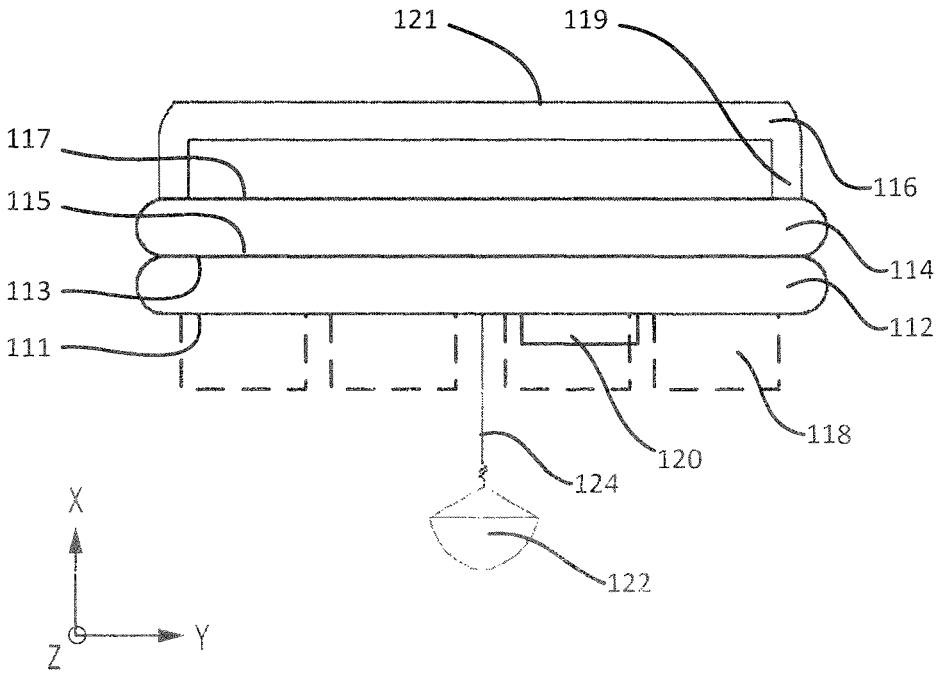
FIG. 1B illustrates a side view of a self-orienting life raft, in accordance with various embodiments.

Referring now to FIG. 1B, a side view of self-orienting raft 100 is illustrated, in accordance with various embodiments. As discussed above, self-orienting raft 100 may comprise a first tube wall 112 and second tube wall 114. First tube wall 112 may comprise a bottom surface 111 and a top surface 113. Second tube wall 114 may comprise a bottom surface 115 and a top surface 117. Bottom surface 111 of first tube wall 112 may be coupled to first side 104 of base 102. Top surface 113 of first tube wall 112 may be coupled to bottom surface 115 of second tube wall 114 such that second tube wall 114 extends above first tube wall 112 in the x-direction.

With further reference to FIG. 1B, canopy 116 may be coupled to and in fluid communication with second tube wall 114 and be configured to inflate due to the passage of gases through first tube wall 112 and second tube wall 114. Canopy 116 may comprise one or more canopy arms 119, which may be coupled to and in fluid communication with top surface 117 of second tube wall 114 and cover portion 121 coupled to and in fluid communication with top surface 117. Cover portion 121 may comprise a diameter similar to a diameter of base 102 and be configured to cover the passenger compartment. In this way, canopy 116 may provide overhead shelter from weather for passengers on self-orienting raft 100.

Still referring to FIG. 1B, self-orienting raft 100 may further comprise one or more ballast bags 118 coupled to second side 106 of base 102. Ballast bags 118 may be configured fill with water and increase stability of self-orienting raft 100. Self-orienting raft 100 may further comprise a charged cylinder 120 and anchor 122 coupled to second side 106 of base 102. In various embodiments, anchor 122 may comprise a sea anchor configured to fill with water and sink, however, anchor 122 is not limited in this regard and may comprise a weighted element, for example. As will be discussed in more detail below, charged cylinder 120 and anchor 122 may be coupled to second side 106 proximate to a geometric center of base 102 when self-orienting raft 100 is in an inflated configuration. Anchor 122 may be coupled to second side 106 by anchor cord 124.

Figure 2:
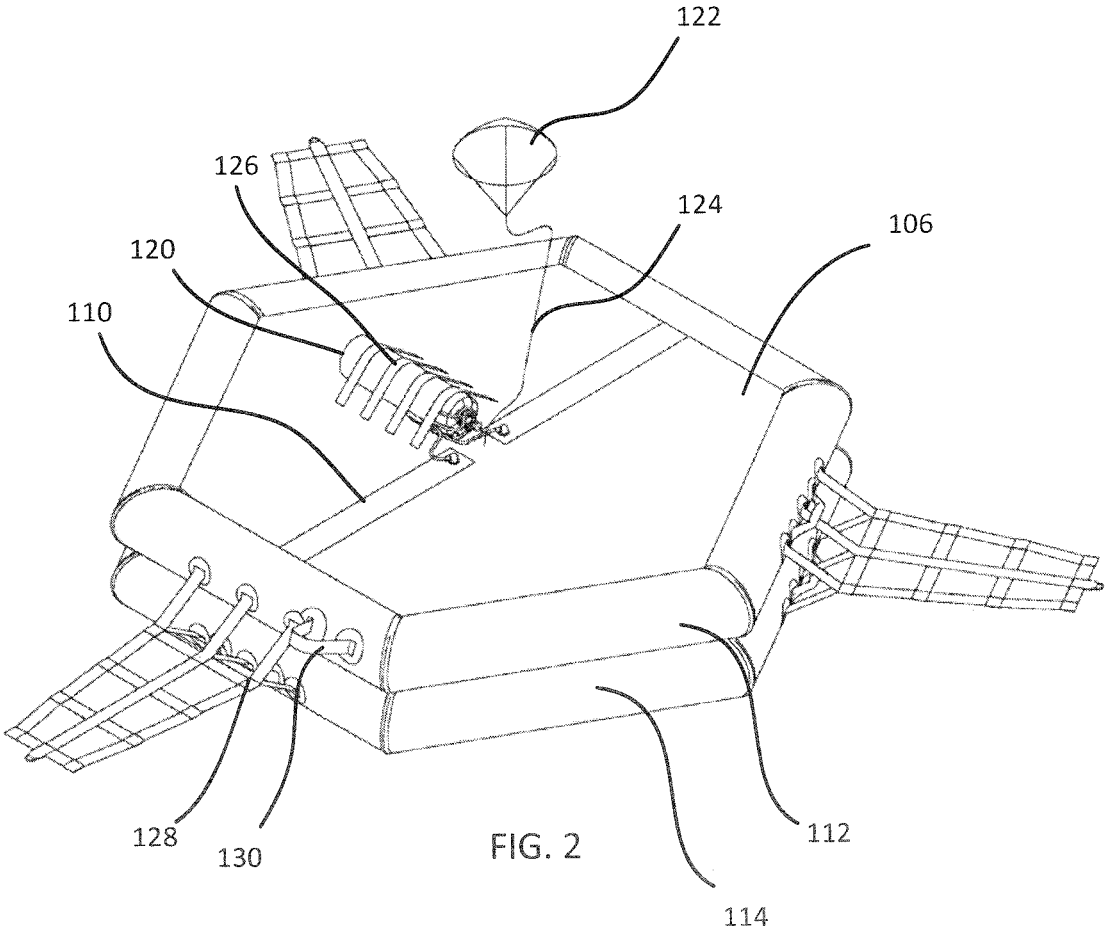
FIG. 2 illustrates a bottom perspective view of a self-orienting life raft, in accordance with various embodiments.

Referring now to FIG. 2, self-orienting raft 100 is illustrated in a bottom perspective view, in accordance with various embodiments. Self-orienting raft 100 may further comprise at least one cylinder strap 126 coupled to second side 106 and configured to hold charged cylinder 120 against second side 106. Self-orienting raft 100 may further comprise one or more strap ladders 128 coupled to first tube wall 112 and second tube wall 114 and one or more strap handles 130 coupled to first tube wall 112 and adjacent to strap ladders 128. Together, strap ladders 128 and strap handles 130 may assist passengers in climbing into self-orienting raft 100 from a body of water.

Figure 3A:
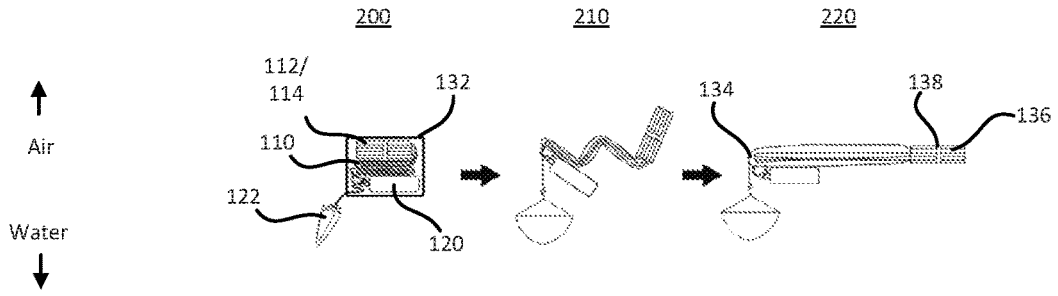
FIG. 3A illustrates a side view of a self-orienting raft transitioning from a packed configuration into a folded configuration, in accordance with various embodiments.

Referring now to FIG. 3A, self-orienting raft 100 is illustrated transitioning from a packed configuration into a folded configuration from a side view, in accordance with various embodiments. FIG. 3A illustrates self-orienting raft 100 in packed configuration 200, first intermediate configuration 210, and folded configuration 220. In packed configuration 200, self-orienting raft 100 may be situated in a pack 132 such that inflation tubes 110 and first tube wall 112 and second tube wall 114 are folded adjacent to charged cylinder 120. Pack 132 may be in the form of a hard pack with a rigid casing or a soft pack with a flexible casing in various embodiments. In folded configuration 220, self-orienting raft may comprise a first end 134 and a second end 136 opposite first end 134. At first end 134, base 102 may be folded in half with anchor 122 and charged cylinder 120 each coupled proximate to first end 134. At second end 136, first and second tube walls 112, 114 may be folded and secured by a strap or other securing apparatus 138. Securing apparatus 138 may be configured to fail in response to a threshold force resulting from inflation of self-orienting raft 100.

Moving from left to right as indicated by the arrows, self-orienting raft 100 may begin in packed configuration 200. Self-orienting raft 100 may be folded and placed in packed configuration 200 in order to limit space required to store and transport self-orienting raft 100 prior to deployment. In response to an emergency, self-orienting raft 100 may be activated by pulling an activation cord or from forces resulting from impact of self-orienting raft 100 with a water surface. Upon activation, anchor 122 may be released from packed configuration 200 and fill with water and begin to sink. Self-orienting raft 100 may extend from packed configuration 200 to first intermediate configuration 210, then to folded configuration 220 due to elastic forces in self-orienting raft 100. In folded configuration 220, charged cylinder 120 and anchor 122 may be positioned proximate to first end 134 of self orienting raft 100. The weight of charged cylinder 120 may provide a downward (toward the water surface) force on first end 134 of self-orienting raft 100, thereby preventing excessive "bobbing" of first end 134 in the water. Anchor 122, now completely filled with water and at a maximum depth, may further provide drag forces to ensure first end 134 does not lift from the water surface during inflation.

Figure 3B:
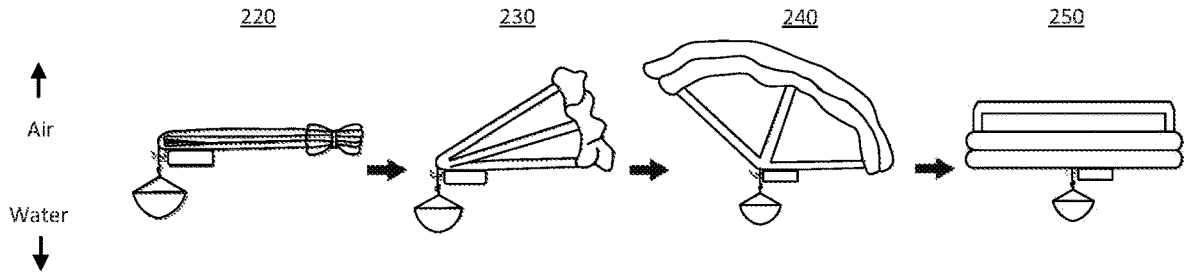
FIG. 3B illustrates a side view of a self-orienting raft transitioning from a folded configuration into an inflated configuration, in accordance with various embodiments.

Referring now to FIG. 3B, self-orienting raft 100 is illustrated transitioning from a folded configuration to an inflated configuration from a side view in accordance with various embodiments. FIG. 3B illustrates self-orienting raft in folded configuration 220, a second intermediate configuration 230, a third intermediate configuration 240, and an inflated configuration 250. As previously discussed, before inflation, first tube wall 112 and second tube wall 114 may be secured using a strap or other securing apparatus 138 at second end 136. A valve coupled to charged cylinder 120 may open, thereby releasing compressed gases and inflating self-orienting raft 100. Upon reaching a threshold force due to inflation of first tube wall 112 and second tube wall 114, the strap or other securing apparatus 138 may separate, allowing self-orienting raft 100 to fully inflate. As depicted in second and third intermediate configurations 230, 240, gases may be transferred to first tube wall 112 and second tube wall 114 through inflation tubes 110. Charged cylinder 120 and/or anchor 122, each coupled proximate to first end 134, may prevent excessive movement of first end 134, thereby reducing the likelihood that self-orienting raft 100 turns over in the water. As a result, self-orienting raft 100 may unfold and inflate in the proper configuration with first side 104 facing away from the water surface (which may be considered upward) and second face 106 facing toward the water surface (which may be considered downward). In inflated configuration 250, each of the charged cylinder 120 and anchor 122 may be coupled to the second side of the base 102 proximate to the geometric center of the base.

Figure 4:
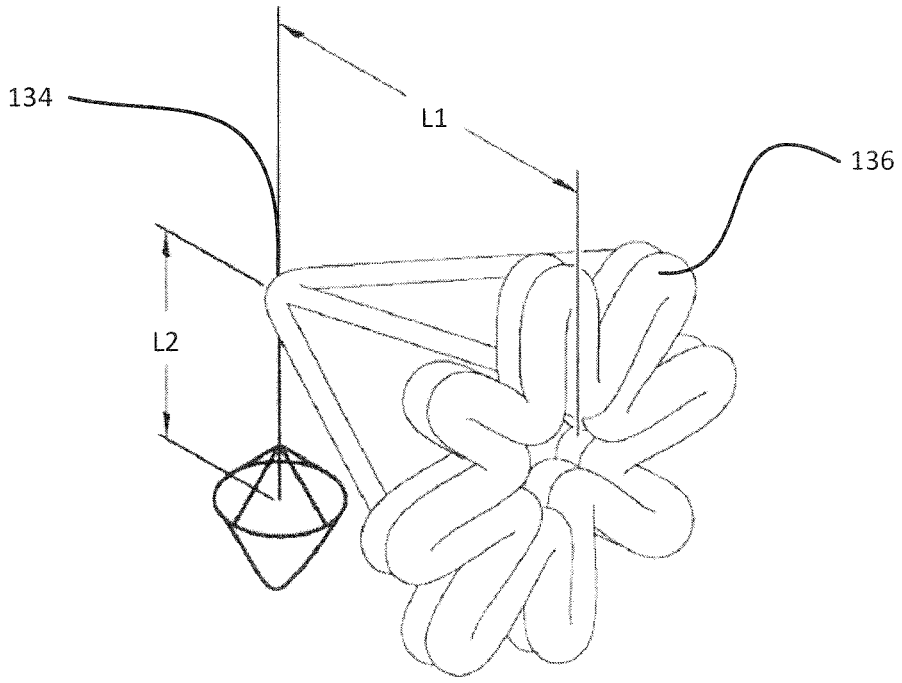
FIG. 4 illustrates a perspective view of a self-orienting raft in an intermediate configuration, in accordance with various embodiments.

Referring now to FIG. 4, self-orienting raft 100 is illustrated in second intermediate configuration 230 from a perspective view, in accordance with various embodiments. Self-orienting raft 100 may comprise a length from first end 134 to second end 136, denoted "L1", L1 may be approximately half an overall diameter of base 102 when self-orienting raft 100 is in an inflated configuration. Anchor cord 124 may comprise a length, denoted "L2." In various embodiments, L1 and L2 may be configured such that L1 is greater than or equal to L2. Such a configuration helps to ensure that self-orienting raft 100 opens in the intended configuration by ensuring that anchor 122 provides sufficient drag to first end 134 as self-orienting raft 100 transitions from folded configuration 220 to inflated configuration 250.

Figure 5:
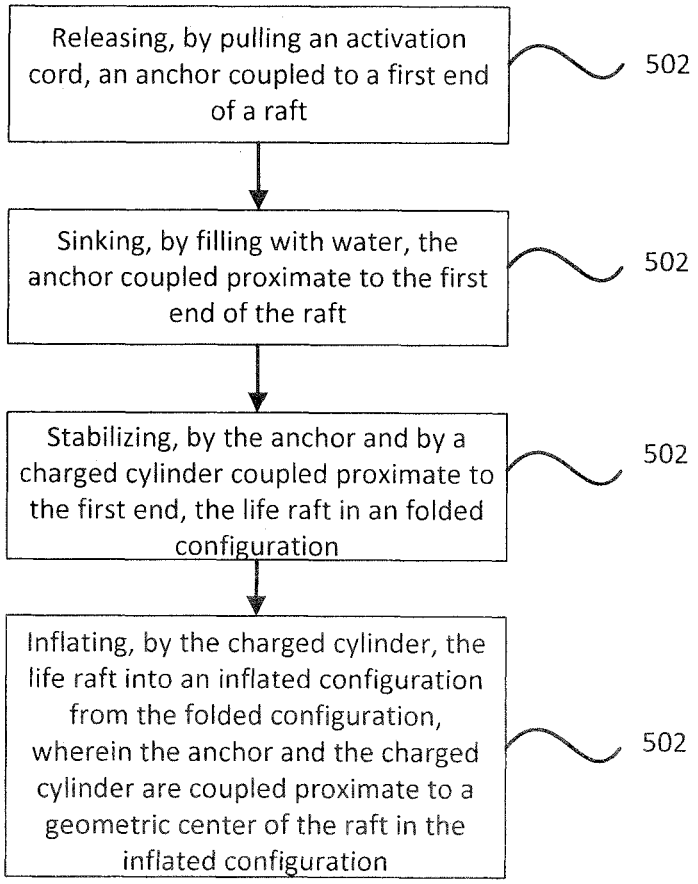
FIG. 5 illustrates a method for deploying a self-orienting life raft, in accordance with various embodiments.

Referring now to FIG. 5, a method for deploying a self-orienting raft is illustrated, in accordance with various embodiments. Method 500 may comprise releasing, by pulling an activation cord, an anchor (Step 502). The method may further comprise sinking, by filling with water, the anchor coupled proximate to the first end of the raft (Step 504). The method may further comprise stabilizing, by the anchor and by a charged cylinder coupled proximate to the first end, the life raft in a folded configuration (Step 506). The method may further comprise inflating, by the charged cylinder, the life raft into an inflated configuration from the folded configuration, wherein the anchor and charged cylinder are coupled proximate to a geometric center of the raft in the inflated configuration (Step 508).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular s not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods, systems, and computer-readable media are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A self-orienting raft system, comprising:

a base comprising a first side and a second side opposite the first side;

a first tube wall coupled to the first side of the base;

a charged cylinder coupled to a second side of the base; and an anchor coupled to a second side of the base;

wherein the charged cylinder and the anchor are coupled to the second side of the base proximate to a geometric center of the base when the self-orienting raft system is in an inflated configuration.

2. The self-orienting raft system of claim 1, further comprising a plurality of inflation tubes coupled to a central chamber and the first tube wall.

3. The self-orienting raft system of claim 2, wherein the central chamber, the plurality of inflation tubes, the first tube wall, and a second tube wall coupled to the first tube wall are in fluid communication.

4. The self-orienting raft system of claim 1, wherein the charged cylinder and the anchor are coupled to the self-orienting raft system proximate to a first end when the self-orienting raft system is in a folded configuration.

5. The self-orienting raft system of claim 1, wherein the second side is configured to interface with a water surface in the inflated configuration.

6. The self-orienting raft system of claim 1, wherein the anchor is a sea anchor configured to sink prior to inflation of the self-orienting raft system.

7. The self-orienting raft system of claim 3, further comprising a canopy comprising at least one canopy arm coupled to and in fluid communication with a top surface of the second tube wall.

8. The self-orienting raft system of claim 3, wherein the first tube wall comprises a bottom surface and a top surface and the second tube wall comprises a bottom surface and a top surface, the top surface of the first tube wall being coupled to and in fluid communication with the bottom surface of the second tube wall.

9. The self-orienting raft system of claim 3, wherein the first tube wall and the second tube wall define a perimeter of the first side of the base.

10. The self-orienting raft system of claim 3, wherein the first tube wall, the second tube wall, and the first side of the base form a passenger compartment.

11. The self-orienting raft system of claim 1, wherein the anchor is coupled to the self-orienting raft system using anchor cord.

12. The self-orienting raft system of claim 11, wherein a length of the anchor cord is less than half a diameter of the base of the self-orienting raft system in the inflated configuration.

13. A raft pack, comprising a raft body comprising a base comprising a first side and a second side;

a charged cylinder coupled to the raft body; and an anchor coupled to the raft body, wherein the anchor and the charged cylinder are coupled to the second side of the base proximate to a geometric center of the raft body when the raft body is in an inflated configuration.

14. The raft pack of claim 13, wherein the anchor is coupled proximate to a first end of the raft body when the raft body is in a folded configuration.

15. The raft pack of claim 13, wherein the anchor is configured to sink prior to inflation of the raft body.

16. The raft pack of claim 13, wherein the raft body further comprises a canopy comprising at least one canopy arm.

17. A method for deploying a raft, comprising:

releasing, by pulling an activation cord, an anchor;

sinking, by filing with water, the anchor coupled proximate to a first end of the raft;

stabilizing, by the anchor and by a charged cylinder coupled proximate to the first end, the raft in a folded configuration; and inflating, by the charged cylinder, the raft into an inflated configuration from the folded configuration.

18. The method of claim 17, wherein the anchor is coupled proximate to a geometric center of the raft in the inflated configuration.

* * * * *